US008816914B2

(12) United States Patent
Wong et al.

(10) Patent No.: US 8,816,914 B2
(45) Date of Patent: Aug. 26, 2014

(54) COMMUNICATION DEVICE AND ANTENNA STRUCTURE THEREIN

(75) Inventors: Kin-Lu Wong, Kaohsiung (TW); Fang-Hsien Chu, Kaohsiung (TW)

(73) Assignee: Acer Incorporated, Taipei Hsien (TW)

( * ) Notice: Subject to any disclaimer, the term of this patent is extended or adjusted under 35 U.S.C. 154(b) by 217 days.

(21) Appl. No.: 13/557,839

(22) Filed: Jul. 25, 2012

(65) Prior Publication Data

US 2013/0300615 A1 Nov. 14, 2013

(30) Foreign Application Priority Data

May 10, 2012 (TW) ..... 101116620 A

(51) Int. Cl.
*H01Q 1/24* (2006.01)
*H01Q 1/38* (2006.01)

(52) U.S. Cl.
CPC . *H01Q 1/243* (2013.01); *H01Q 1/38* (2013.01)
USPC ..... 343/702; 343/700 MS

(58) Field of Classification Search
CPC ..... H01Q 1/243; H01Q 1/38; H01Q 13/10
USPC ..... 343/702, 700 MS, 846, 741, 866
See application file for complete search history.

(56) References Cited

U.S. PATENT DOCUMENTS

| | | | | |
|---|---|---|---|---|
| 2008/0180333 | A1* | 7/2008 | Martiskainen et al. | 343/722 |
| 2010/0123633 | A1* | 5/2010 | Ozden et al. | 343/702 |
| 2012/0098719 | A1* | 4/2012 | Mumbru et al. | 343/725 |
| 2013/0249768 | A1* | 9/2013 | Anguera Pros et al. | 343/872 |

FOREIGN PATENT DOCUMENTS

| | | |
|---|---|---|
| EP | 1 530 258 | 5/2005 |
| WO | WO 2009/085406 | 7/2009 |

OTHER PUBLICATIONS

European Search Report dated Jan. 9, 2013.
Chiu, C.W., et al.; "Multiband Folded Loop Antenna for Smart Phones;" Progress in Electromagnetics Research; Pier 102; 2010; pp. 213-226.
Morishita, H., et al.; "Design Concept of Antennas for Small Mobile Terminals and the Future Perspective;" IEEE Antenna's and Propagation Magazine; vol. 44; No. 5; Oct. 2002; pp. 30-43.

* cited by examiner

*Primary Examiner* — Hoanganh Le
(74) *Attorney, Agent, or Firm* — McClure, Qualey & Rodack, LLP

(57) ABSTRACT

A communication device including a multilayer circuit board and an antenna structure therein is provided. The multilayer circuit board has at least a first plane, a second plane, and a third plane. A ground plane is disposed on one of the planes, and the ground plane is in proximity to a clearance region of the multilayer circuit board. An antenna structure is disposed in the clearance region. The antenna structure includes a first metal portion and a second metal portion. The first metal portion is coupled to a signal source through a feeding portion. The second metal portion includes at least a first line segment and a second line segment. The first line segment and the second line segment are disposed respectively on any two planes of the multilayer circuit board. The first metal line and the second metal line forms a loop structure through two conductive vias.

11 Claims, 5 Drawing Sheets

COMMUNICATION DEVICE AND ANTENNA STRUCTURE THEREIN

CROSS REFERENCE TO RELATED APPLICATIONS

This Application claims priority of Taiwan Patent Application No. 101116620 filed on May 10, 2012, the entirety of which is incorporated by reference herein.

BACKGROUND OF THE INVENTION

1. Field of the Invention

The disclosure generally relates to a communication device, and more particularly, relates to an ultra-thin communication device comprising a multilayer circuit board and an antenna structure therein.

2. Description of the Related Art

With recent, rapid development in wireless communication technology, mobile communication devices become thinner and lighter. As people need more and more functions in mobile communication devices, there is less and less space in the mobile communication devices for accommodating antennas. How to design an antenna within the limited space of a thin mobile communication device is a hard challenge for an antenna designer.

A traditional printed antenna is directly printed on a system circuit board in a mobile communication device. The printed antenna almost has no height on the system circuit board, thereby suitably being applied to ultra-thin mobile communication devices. However, the traditional printed antenna does not effectively use the multilayered structure of the system circuit board to cover broad range of multiple bands.

Therefore, there is a need to design a new multilayer circuit board and an antenna structure therein, wherein a portion of the antenna structure is printed in the multilayer circuit board so as to save the space occupied by the antenna structure. In addition, the antenna structure can cover a broad range of multiple bands, thereby being suitably applicable for ultra-thin mobile communication devices.

BRIEF SUMMARY OF THE INVENTION

The invention is aimed at providing an ultra-thin communication device comprising a multilayer circuit board and a printed antenna structure therein. A loop structure is formed at an end portion of the antenna structure to effectively increase surface currents on the end portion and to distribute the surface currents more uniformly. Accordingly, the impedance matching of the antenna structure is improved, and the bandwidth of the antenna structure is increased. In addition, the loop structure effectively reduces near-field electromagnetic fields at the end portion of the antenna structure, and accordingly, the antenna structure is easily integrated with an adjacent ground plane such that the size of a clearance region required by the antenna structure is reduced. Printing the loop structure in the multilayer circuit board saves the space occupied by the antenna structure, and the antenna structure is suitably applicable to an ultra-thin communication device.

In one embodiment, the disclosure is directed to a communication device, comprising: a multilayer circuit board, having at least a first plane, a second plane and a third plane, wherein one of the first plane, the second plane and the third plane has a ground plane, and the ground plane is in proximity to a clearance region of the multilayer circuit board, and the clearance region is configured to accommodate an antenna structure, wherein the antenna structure comprises: a first metal portion, coupled through a feeding portion to a signal source; and a second metal portion, comprising at least a first line segment and a second line segment, wherein the first line segment and the second line segment are respectively disposed on any two planes of the first plane, the second plane and the third plane, and the first line segment is coupled through at least two conductive vias to the second line segment so as to form a loop structure, and the loop structure is substantially located at an end portion of the second metal portion and substantially perpendicular to the ground plane.

In the communication device of the invention, since the end portion of the antenna structure has small near-field electromagnetic fields, the clearance region may have at least two edges which are surrounded by the ground plane. In some embodiments, the ground plane substantially has an L-shape or a U-shape. In a preferred embodiment, the first line segment and the second line segment substantially have a same length, and the length is greater than or equal to 0.05 wavelength of the lowest operating frequency of the antenna structure so as to provide uniform surface currents for the end portion of the antenna structure. The first metal portion is electrically coupled through a shorting portion to the ground plane. The antenna structure is excited to form at least one resonant mode in a first (low frequency) operating band and at least one higher-order resonant mode in a second (high frequency) operating band. Each of the first and second operating bands covers at least one mobile communication band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures in the invention are described in detail as follows.

Figure 1:
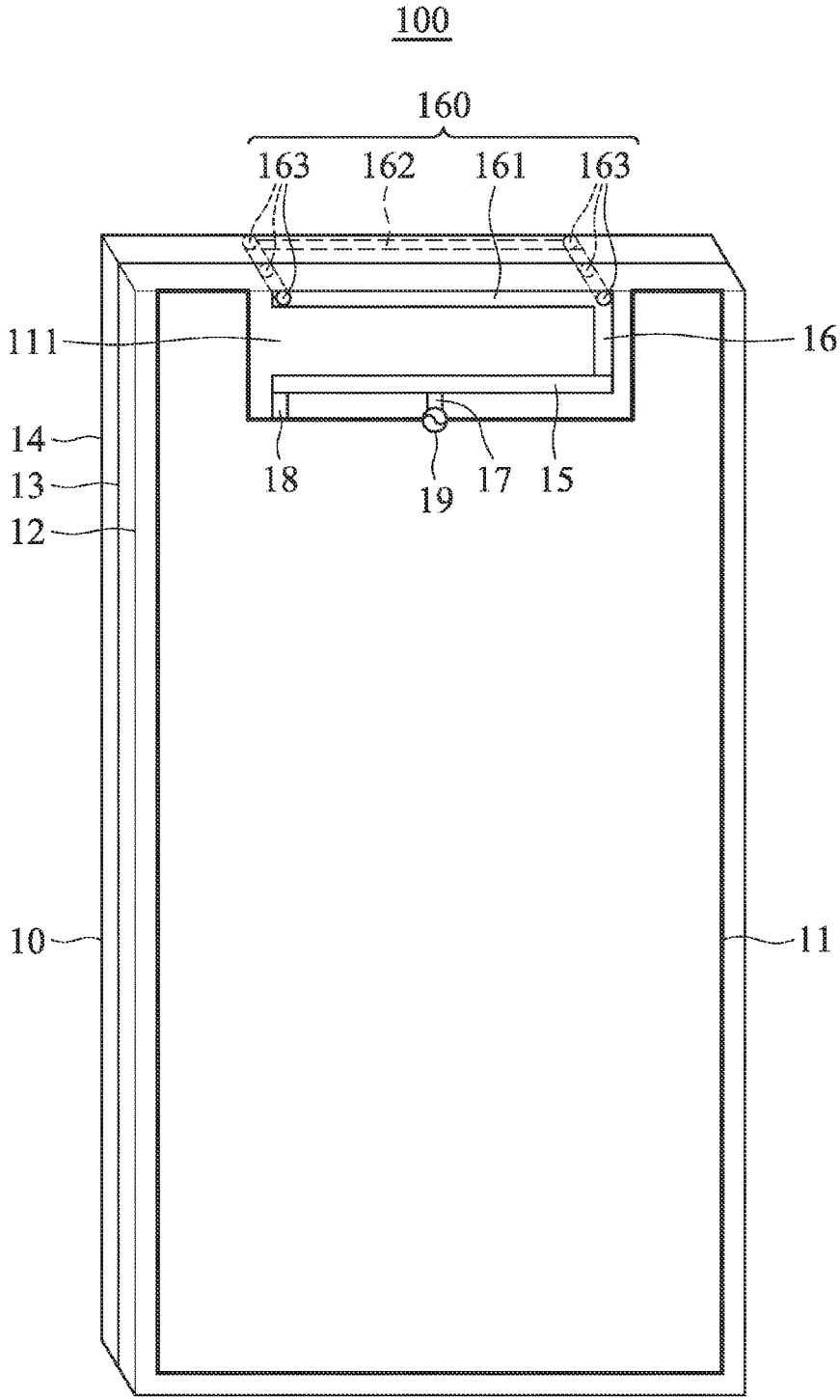
FIG. 1 is a diagram for illustrating a communication device according to a first embodiment of the invention.

FIG. 1 is a diagram for illustrating a communication device 100 according to a first embodiment of the invention. In the embodiment, the communication device 100 comprises a multilayer circuit board 10 and an antenna structure which is printed on the multilayer circuit board 10. The multilayer circuit board 10 has at least a first plane 12, a second plane 13 and a third plane 14, wherein one of the first plane 12, the second plane 13 and the third plane 14 has a ground plane 11. Note that in the embodiment, the ground plane 11 is disposed on the first plane 12, but the invention is not limited thereto. In other embodiments, the ground plane 11 may be disposed on the second plane 13 or the third plane 14.

Referring to FIG. 1, the ground plane 11 is in proximity to a clearance region 111 of the multilayer circuit board 10, and the clearance region 111 is configured to accommodate the antenna structure. The antenna structure comprises a first metal portion 15 and a second metal portion 16. The first metal portion 15 is electrically coupled through a feeding portion 17 to a signal source 19. The second metal portion 16 comprises at least a first line segment 161 and a second line segment 162. In an embodiment, the first line segment 161 and the second line segment 162 are disposed on the first plane 12 and the third plane 14, respectively. The first line segment 161 is electrically coupled through at least two conductive vias 163 to the second line segment 162 so as to form a loop structure 160. In other embodiments, the first line segment 161 and the second line segment 162 are respectively disposed on any two planes of the first plane 12, the second plane 13 and the third plane 14. The loop structure 160 is substantially located at an end portion of the second metal portion 16 and substantially perpendicular to the ground plane 11. In some embodiments, the antenna structure further comprises a shorting portion 18, and the first metal portion 15 is electrically coupled through the shorting portion 18 to the ground plane 11. In the embodiment, the ground plane 11 substantially has a U-shape, and three edges of the clearance region 111 are surrounded by the ground plane 11.

Figure 2:
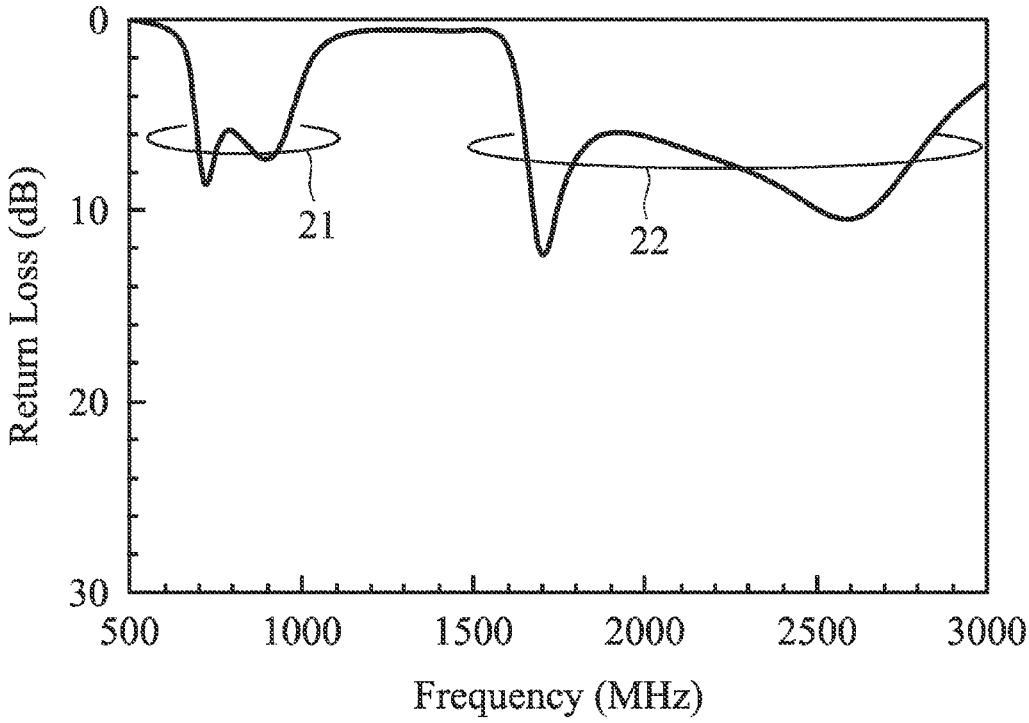
FIG. 2 is a diagram for illustrating return loss of an antenna structure according to the first embodiment of the invention.

FIG. 2 is a diagram for illustrating return loss of the antenna structure according to the first embodiment of the invention. In some embodiments, the multilayer circuit board 10 has a length of about 115 mm, a width of about 60 mm, and a thickness of about 0.8 mm, and the clearance region 111 has an area of about 400 $mm^2$ (40 mm by 10 mm). The ground plane 11 is disposed on the first plane 12 of the multilayer circuit board 10. According to the criterion of 6 dB return loss (the antenna design specification of mobile communication devices), the antenna structure in the first embodiment is excited to form a first operating band 21 and a second operating band 22. In a preferred embodiment, the first operating band 21 may cover three-band LTE700/GSM850/900 operation (about from 704 MHz to 960 MHz), and the second operating band 22 may cover five-band GSM1800/1900/UMTS/LTE2300/2500 operation (about from 1710 MHz to 2690 MHz). Therefore, the antenna structure of the invention may cover eight-band WWAN/LTE operation.

Figure 3:
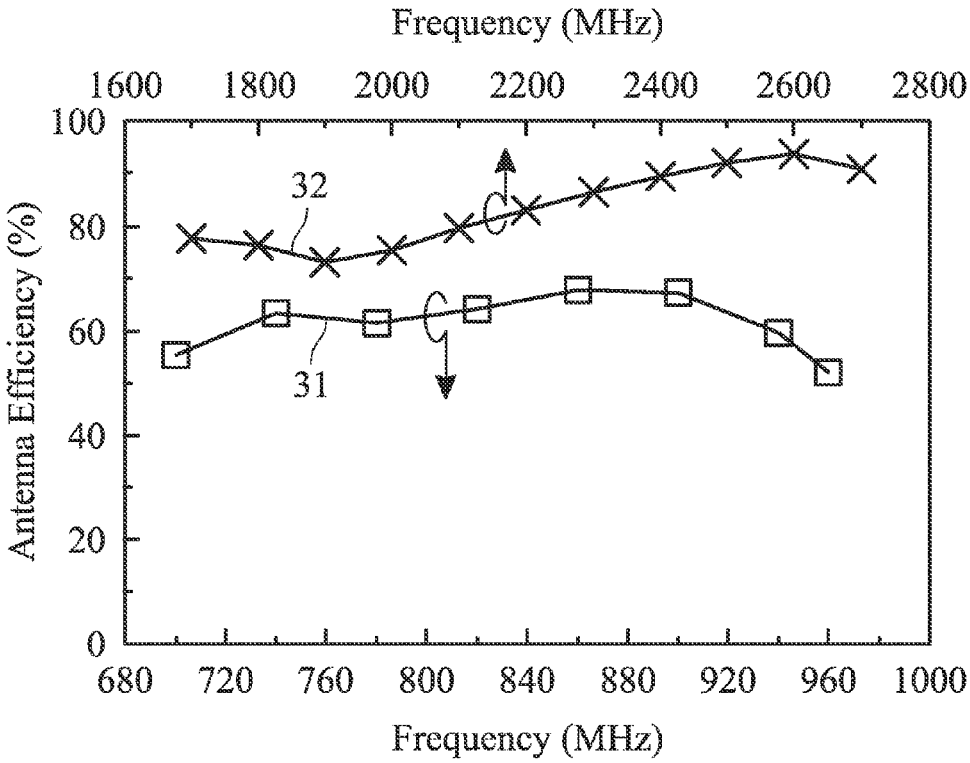
FIG. 3 is a diagram for illustrating antenna efficiency of the antenna structure according to the first embodiment of the invention.

FIG. 3 is a diagram for illustrating antenna efficiency of the antenna structure according to the first embodiment of the invention. The antenna efficiency curve 31 represents the antenna efficiency of the antenna structure which operates in LTE700/GSM850/900 bands, and the antenna efficiency curve 32 represents the antenna efficiency of the antenna structure which operates in GSM1800/1900/UMTS/LTE2300/2500 bands. As shown in FIG. 3, the antenna structure of the invention has good antenna efficiency (the antenna efficiency includes the return loss) for frequencies in the WWAN/LTE bands to meet practical applications.

Figure 4:
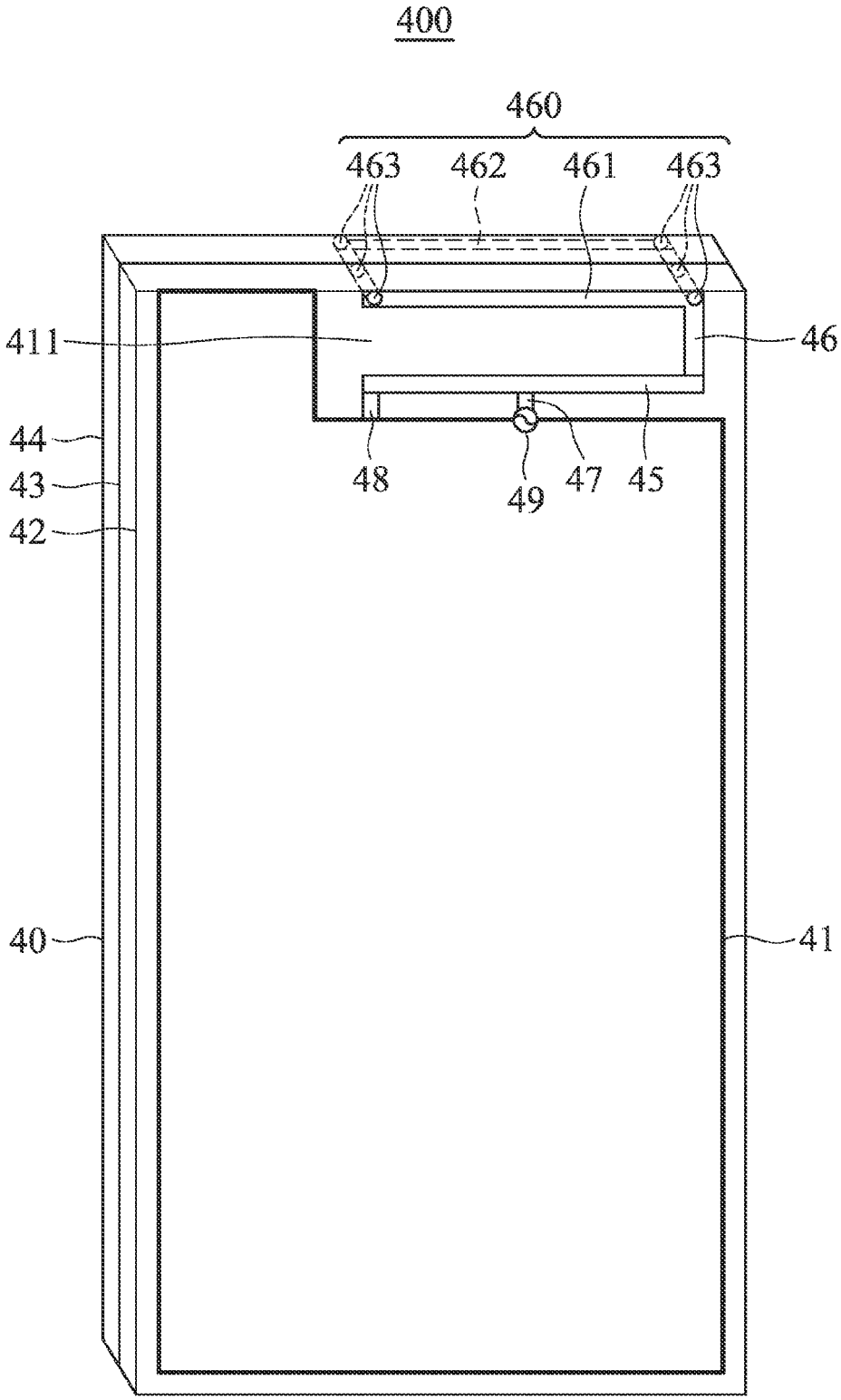
FIG. 4 is a diagram for illustrating a communication device according to a second embodiment of the invention.

FIG. 4 is a diagram for illustrating a communication device 400 according to a second embodiment of the invention. The main difference between the second embodiment and the first embodiment is that the antenna structure in the second embodiment is disposed on a clearance region 411, which is located at a corner of a multilayer circuit board 40. In the second embodiment, a ground plane 41 substantially has an L-shape, and two edges of the clearance region 411 are surrounded by the ground plane 41. Other features of the second embodiment are similar to those of the first embodiment. Therefore, the communication devices in the first and second embodiments have similar performance.

Figure 5:
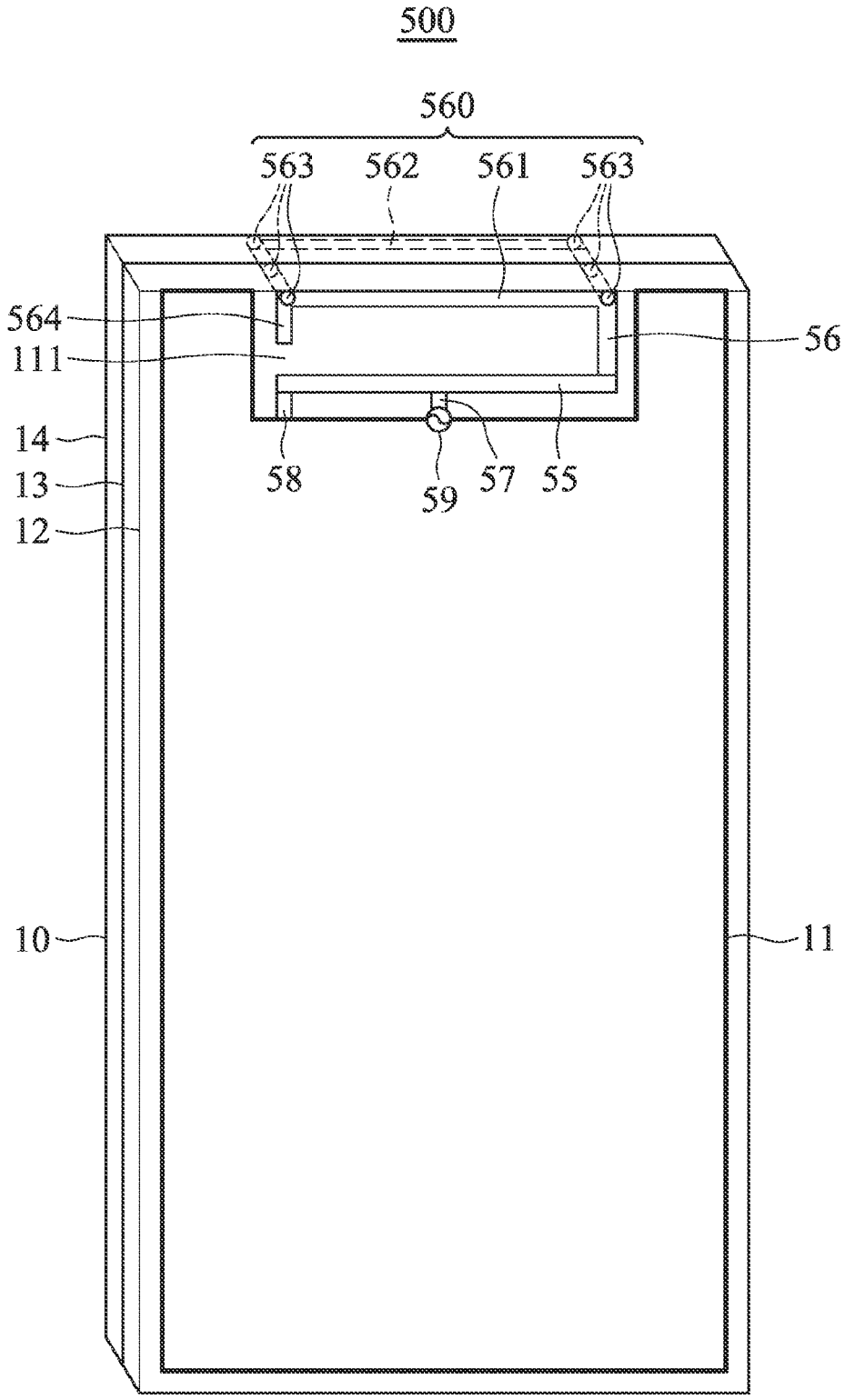
FIG. 5 is a diagram for illustrating a communication device according to a third embodiment of the invention.

FIG. 5 is a diagram for illustrating a communication device 500 according to a third embodiment of the invention. The main difference between the third embodiment and the first embodiment is that a second metal portion 56 in the third embodiment further comprises a third line segment 564, and one end of a first line segment 561 of the second metal portion 56 is electrically coupled to the third line segment 564. The third line segment 564 is used to adjust the resonant length of the antenna structure and to fine tune the resonant modes of the antenna structure. The third line segment 564 is substantially perpendicular to the first line segment 561. Other features of the third embodiment are similar to those of the first embodiment. Therefore, the communication devices in the first and third embodiments have similar performance.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A communication device, comprising:

a multilayer circuit board, comprising at least a first plane, a second plane and a third plane, wherein one of the first plane, the second plane and the third plane has a ground plane, and the ground plane is in proximity to a clearance region of the multilayer circuit board, and the clearance region is configured to accommodate an antenna structure, wherein the antenna structure comprises:

a first metal portion, coupled through a feeding portion to a signal source; and a second metal portion, comprising at least a first line segment and a second line segment, wherein the first line segment and the second line segment are respectively disposed on any two planes of the first plane, the second plane and the third plane, and the first line segment is coupled through at least two conductive vias to the second line segment so as to form a loop structure, and the loop structure is substantially located at an end portion of the second metal portion and substantially perpendicular to the ground plane.

2. The communication device as claimed in claim 1, wherein at least two edges of the clearance region are surrounded by the ground plane.

3. The communication device as claimed in claim 1, wherein the ground plane substantially has an L-shape.

4. The communication device as claimed in claim 1, wherein the ground plane substantially has a U-shape.

5. The communication device as claimed in claim 1, wherein the first line segment and the second line segment substantially have a same length, and the length is greater than or equal to 0.05 wavelength of the lowest operating frequency of the antenna structure.

6. The communication device as claimed in claim 1, wherein the antenna structure further comprises a shorting portion, and the first metal portion is coupled through the shorting portion to the ground plane.

7. The communication device as claimed in claim 1, wherein the clearance region is located at a corner of the multilayer circuit board.

8. The communication device as claimed in claim 1, wherein the second metal portion further comprises a third line segment, and one end of the first line segment of the second metal portion is coupled to the third line segment.

9. The communication device as claimed in claim 8, wherein the third line segment is substantially perpendicular to the first line segment.

10. The communication device as claimed in claim 1, wherein the antenna structure is excited to form a first operating band and a second operating band.

11. The communication device as claimed in claim 10, wherein the first operating band is approximately from 704 MHz to 960 MHz, and the second operating band is approximately from 1710 MHz to 2690 MHz.

* * * * *